United States Patent [19]

Kulka et al.

[11] Patent Number: 4,952,899

[45] Date of Patent: Aug. 28, 1990

[54] SHUNT HOLDING MEANS FOR BALLASTS

[75] Inventors: Robert A. Kulka, Livington, N.J.; Raymond H. Van Wagener, Darien, Conn.; Lothar Freimuth, Franklin Lakes, N.J.

[73] Assignee: Magnetek Universal Manufacturing Corporation, Paterson, N.J.

[21] Appl. No.: 331,517

[22] Filed: Mar. 31, 1989

[51] Int. Cl.[5] ..... H01F 21/08; H01F 27/26

[52] U.S. Cl. ..... 336/160; 336/165; 336/198; 336/210

[58] Field of Search ..... 336/210, 198, 208, 165, 336/100, 155, 160

[56] References Cited

U.S. PATENT DOCUMENTS

| | | | |
|---|---|---|---|
| 2,180,759 | 11/1939 | Kneisley | 336/100 |
| 2,850,708 | 9/1958 | Antalis | 336/160 X |
| 3,010,050 | 11/1961 | Hume et al. | 336/165 X |
| 4,400,675 | 8/1983 | Thomas | 336/160 |
| 4,730,178 | 3/1988 | Gunnels et al. | 336/165 X |
| 4,800,357 | 1/1989 | Nickels, Jr. et al. | 336/210 X |

*Primary Examiner*—Thomas J. Kozma
*Attorney, Agent, or Firm*—Darby & Darby

[57] ABSTRACT

A ballast assembly for a fluorescent lighting fixture includes a magnetic core, a primary winding and a secondary winding, both windings mounted on a central leg of the core, with a shunt disposed between the windings to prevent a flux generated by the primary winding from coupling with a flux generated by the secondary winding. The ballast further includes means for securing the shunt comprising a wall placed between the windings, with the wall having one or more structures formed integrally on the wall for engaging the shunt. The wall may comprise a flange of a bobbin, or be free standing. Using formed structures eliminates the need for winding tape around the shunts to provide an air gap between the sunt and the core. This assures long-term stability and reduces the potential for nuisance humming.

5 Claims, 2 Drawing Sheets

FIG. 1
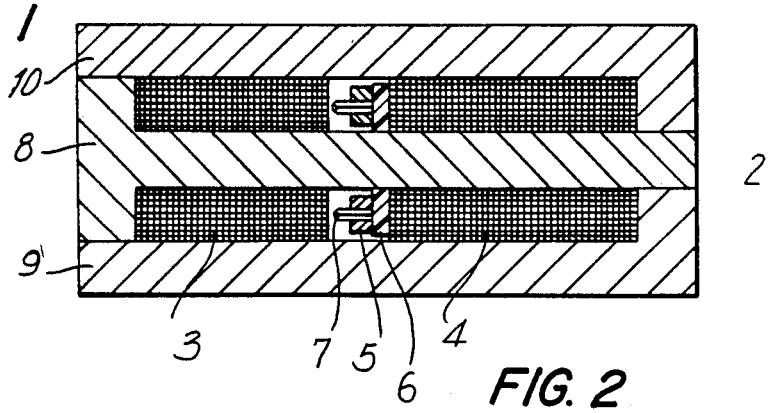
FIG. 2
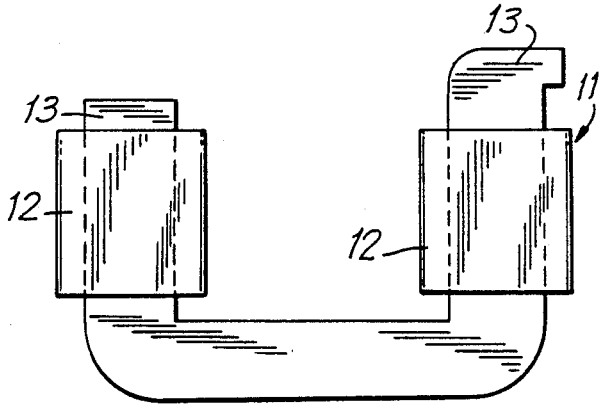
FIG. 4
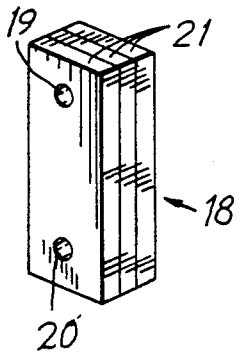
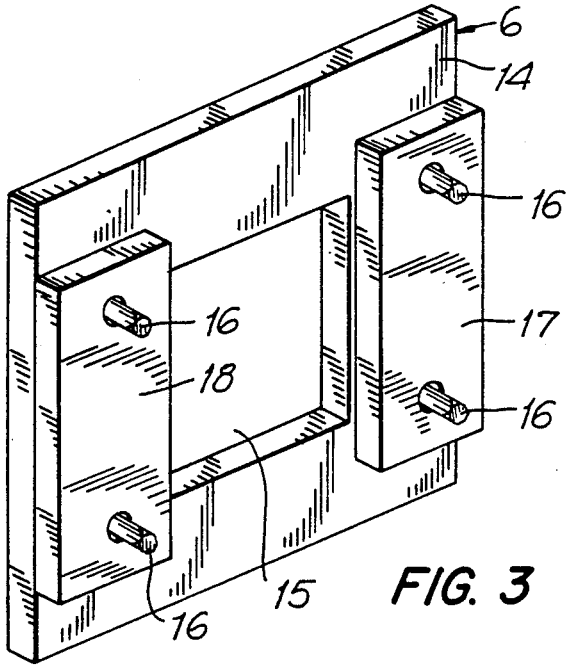
FIG. 3

SHUNT HOLDING MEANS FOR BALLASTS

TECHNICAL FIELD

This invention relates to ballast assemblies and more particularly to a means for mounting a shunt in a ballast assembly.

BACKGROUND OF THE INVENTION

A fluorescent lamp fixture requires a ballast for providing the starting and operating current to one or more fluorescent bulbs. These ballasts utilize a transformer, having a magnetic core and coil assembly including a pair of coils. The magnetic core is usually laminated, i.e. made up of a number of thin ferromagnetic plates insulated from one another. The coils are commonly referred to as a primary and a secondary winding, with each winding formed by winding a thin copper wire on a spool or bobbin made from plastic or some other insulating material. The coils are disposed on a central leg of the magnetic core, with each bobbin having a hollow center for fitting onto the central core leg. Two outside core legs are added to surround the windings to maximize flux concentration. During transformation, energy is transferred from the primary winding to the secondary winding by electromagnetic induction.

Ballast transformers may include one or more ferromagnetic shunts positioned between the primary and secondary windings. Such shunts increase the leakage reactance of the transformer by providing a flux leakage path between the primary and secondary windings. This flux leakage path is controlled by the air gap between the shunt and the core legs. The shunt therefore diverts a portion of the magnetic flux generated by the primary winding to prevent coupling with the flux generated by the secondary winding. Shunted transformers also limit the short circuit current to a greater degree than those transformers that do not include such shunts, with the current reduction varying with the spacing (air gap) between the shunt and the adjacent core.

Generally, a U-shaped shunt, composed of a plurality of planar ferromagnetic laminations, is inserted between the windings, with the upright legs of the shunt wrapped with tape to provide a snug fit between the center and end core legs. The shunt laminations may be held together by the tape, or may be bound with adhesives or fasteners. The thickness of the tape determines the gap between the shunt and the core, with compression of the tape maintaining the proper gap over the life of the ballast.

One problem with the current method for including shunts in transformers is that with time, the tape may deteriorate or cold flow, allowing the shunt to shift position. Not only does this alter the short circuit current, but in typical ballast transformers used for electrical lighting, the shunt may vibrate, causing a low level hum which is considered a nuisance.

SUMMARY OF THE INVENTION

It is an object of the present invention to provide means for securing a shunt in a ballast assembly without tape.

It is a further object of the present invention to provide means for securing a shunt in a ballast assembly with long term stability.

It is a further object of the present invention to provide means for securing a shunt in a ballast assembly with a reduced part cost.

It is another object of the present invention to provide means for securing a shunt in a ballast assembly without requiring nuts, bolts or other separate mechanical fasteners.

It is another object of the present invention to reduce noise by preventing the shunt from contacting the adjacent core laminations.

According to the present invention, a ballast assembly is disclosed including a magnetic core, a primary winding and a secondary winding, both windings placed on a leg of the core, with at least one shunt mounted between the windings. The ballast assembly further has means for securing the shunt in the assembly without tape. These means comprise a wall, positioned between the windings, the wall having a central opening for mating with the central core leg, and, structure means provided on a front surface of the wall for retaining the shunt thereon. The structure means are precisely located on the wall to assure a precise gap between the core and the shunt. In one embodiment, the structure means comprise locking posts formed on and extending perpendicular from the wall, with the posts sized to mate in an interference fit with bores in the shunt. The wall may be separably formed for placement in the assembly, or may comprise a flange of one of the bobbins. Utilizing a wall with formed structures as the securing means assures the long term stability of the shunt in the assembly, while eliminating the labor intensive taping operation.

BRIEF DESCRIPTION OF THE DRAWINGS

FIG. 1 is a cross-sectional view of a typical ballast assembly having primary and secondary windings with a shunt disposed therebetween.

FIG. 2 is an enlarged view of a prior art U-shaped taped shunt.

FIG. 3 is an enlarged view of the shunt mounting wall of the present invention including locking posts.

FIGS. 4 is an enlarged view of a laminated shunt usable with the present invention.

DETAILED DESCRIPTION OF THE INVENTION

Figure 5:
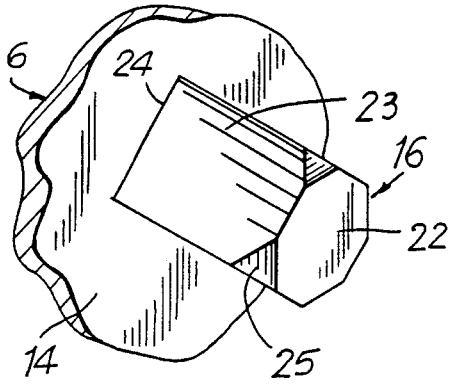
FIG. 5 is an enlarged view of a locking post.

Referring to FIG. 1, a typical ballast assembly is shown, in cross-section. Generally, the ballast assembly 1 includes a magnetic core 2, a primary winding 3 and a secondary winding 4, with a shunt 5 placed between the windings. The shunt is mounted on a wall 6, having posts 7 extending therefrom. The core 2 includes a T-shaped central leg 8 and first and second L-shaped legs, 9 and 10 respectively, with these legs formed from a plurality of ferromagnetic laminations. End core clamps (not shown) hold the laminations in place.

The windings 3 and 4 are manufactured by winding a thin copper wire about a tube or bobbin, having a hollow center sized to slip over the central leg 8. To produce the assembly, the primary winding 3 is slipped onto the T-shaped leg 8, then the wall 6 with the shunt 5 is placed on the leg 8, and the secondary winding 4 then slipped onto the leg. The L-shaped legs, 9 and 10, are then added to complete the core 2. While a ballast transformer including T and L shaped laminations is disclosed, it will be understood by those skilled in the art that many other transformer configurations could benefit from the present invention.

Referring to FIGS. 2, a typical U-shaped shunt 11 is shown made up of a plurality of ferromagnetic laminations, which may be staked, welded or adhesively retained as a stack. The U-shaped shunt 11 has tape 12 provided on the up-right legs 13, with the number of turns of tape determining the gap between the shunt and the core. Sufficient tape is added to provide a snug fit. Of course, adding the tape to the legs is a labor intensive operation. In addition, the cross piece between the upright legs is needed to increase the stability, rather than for providing a flux leakage path.

Figure 6:
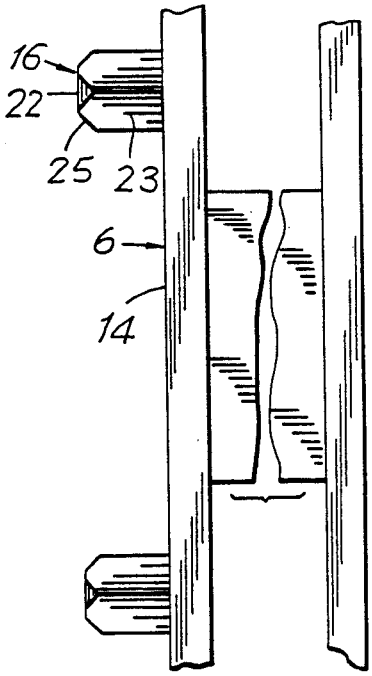
FIG. 6 is an embodiment having the posts extending from a flange of a bobbin.

Referring to FIG. 3, the wall 6 is shown in perspective. The wall 6 has a front surface 14 and a central opening 15 sized to admit a leg of the core therein. The wall 6 is rectangular, and of a sufficient strength to allow handling without breakage. Of course, the wall thickness will differ depending on the strength of the material chosen, and this may vary from application to application. The wall is preferably composed of a plastic such as nylon or polypropylene. While the wall 6 is unattached to any other structure, in some applications, the wall may comprise an end flange of a bobbin. An embodiment incorporating the posts on a flange of a bobbin is shown in FIG. 6.

The wall 6 has four mounting posts 16 extending outwardly from the front surface. While four mounting posts are shown, one or more posts may be used depending on the application.

The posts 16 are formed integrally with the wall through injection molding or by other conventional means. Each post is precisely positioned on the wall for accurately locating a shunt in the ballast assembly. Two shunts 17 and 18 are mounted on the wall 6. Referring to FIG. 4, the shunt 18 has two mounting holes 19 and 20 extending therethrough with the shunt made up of three laminations 21. Each lamination is composed of a ferromagnetic material such as silicon steel, provided in thin sheets of about 0.018 inch thick. The stack thickness may vary, and be up to about 0.75 inch thick.

Generally, the mounting holes may be slightly smaller in diameter than the posts to provide an interference fit and assure firm mounting to provide long term stability. Assembly requires manually or automatically pressing the shunts onto the posts. Since posts are used to mount the shunts, the need for a U-shape for providing shunt stability between the upright legs is eliminated and rectangular shunts may be used. This further enhances performance as a flux path between the upright legs is eliminated. Costs are also reduced as the amount of material needed to produce the shunt is reduced.

Referring to FIG. 5, an enlarged view of a mounting post 16 is shown. The post 16 is essentially cubicle, having a flat forward surface 22 and four side surfaces 23. The cube is placed on edge to maximize vertical and horizontal stability while allowing some tolerance for hole diameter variations. When an interference fit is used, the shunt hole cuts into the edges assuring rigid shunt placement. Of course, other shape posts could be used, such as a round, oblong, rectangular etc.

The post extends about 0.105 to 0.115 inches from the front surface 14 of the wall 6. To assure shunt retention, each post is slightly tapered, having a width at the front face 22 of about 0.060 inches and a width at a base 24 of about 0.070 inches. In addition, each front corner 25 is cut and tapered at about a 45 degree angle.

Figure 7:
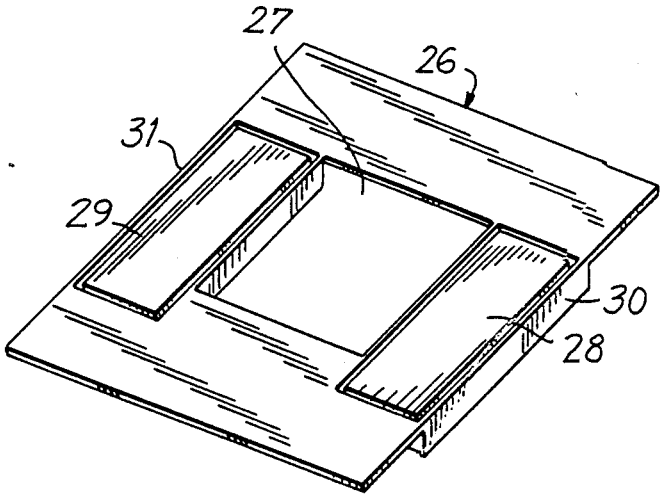
FIG. 7 is a perspective view of an alternative embodiment of the present invention.

Another embodiment of the present invention is shown in FIG. 7. Referring to FIG. 7, a wall 26 has a central opening 27 sized to accept a core leg therein. Two recessed pockets 28 and 29 are formed integrally with the wall, preferably by forming from nylon or another formable plastic that can maintain its strength up to a temperature of about 150 degrees C. The wall 26 has a thickness equal to the desired gap. Therefore, an end wall 30 and 31 of each pocket 28 and 29 provides the air gap.

Figure 8:
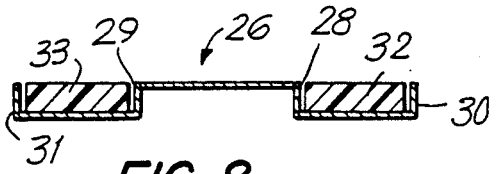
FIG. 8 is a side view of the embodiment of FIG. 7.

Referring to FIG. 8, the wall 26 is shown in cross-section, having two shunts 32 and 33 disposed in the pockets 28 and 29. The pockets are essentially sized to accept the shunts therein and may be slightly smaller to provide a snug fit. Of course, a somewhat resilient plastic material can be chosen to assure firm shunt retention, with assembly requiring pressing the shunts into the recessed pockets. This embodiment avoids a shunt hole drilling or stamping operation, while retaining the benefit of automated assembly. As in the other described embodiment, in some applications, the wall may comprise a flange of a bobbin, while in other instances, a separate wall may be used.

Utilizing posts for mounting shunts on the bobbin reduces the need for a U-shaped shunt as a cross-support is not needed to maintain alignment between the upright legs. Consequently, material and manufacturing costs are reduced. Eliminating taping reduces labor requirements and simplifies shunt insertion, assuring uniform shunt positioning from ballast to ballast. The plastic wall with formed structures is readily mass produced at low cost and provides a means for automating shunt/wall assembly, reducing labor requirements. The shunt holding means of the present invention also provides long term shunt stability, eliminating shunt vibrations and nuisance humming.

While locking posts or pockets are disclosed as the structure means, it will be understood by those skilled in the art that various other structures for mounting shunts on a transformer may be used without varying from the scope of the present invention. In addition, while mounting on a flange of a bobbin is discussed, it will be understood by those skilled in the art that the shunt holding means of the present invention are readily adaptable to ballasts which do not include flanged bobbins.

We claim:

1. A ballast assembly having a magnetic core; a primary winding and a secondary winding, both windings mounted on a central leg of the core; a shunt placed between the windings, the assembly further comprising:

wall means placed between the primary and secondary windings, the wall means having a central opening for accepting the central leg of the core therein; and, structure means, precisely positioned integrally with the wall means, for engaging and retaining the shunt thereon, the structure means comprising at least one post, extending outwardly from a front surface of the wall means, the shunt having at least one hole sized for engaging the post, for holding the shunt at a set distance from the core.

2. The assembly of claim 1 wherein the wall means is a free-standing wall.

3. The assembly of claim 1 wherein the wall means has four posts extending therefrom, each post being cubically shaped and positioned on edge.

4. The assembly of claim 1 wherein each posts tapers downwardly from its base to its top surface to ease mounting of the shunt thereon.

5. The assembly of claim 3 wherein the post has a top square surface, each corner of the top surface tapered at about 45 degrees.

* * * * *